US005983398A

United States Patent [19]

Kronenberger

[11] Patent Number: 5,983,398

[45] Date of Patent: Nov. 16, 1999

[54] HEADWEAR HAVING INTEGRAL CROWN AND HEADBAND

[75] Inventor: Ronald Kronenberger, Riverwoods, Ill.

[73] Assignee: American Needle, Buffalo Grove, Ill.

[21] Appl. No.: 09/035,540

[22] Filed: Mar. 5, 1998

[51] Int. Cl.[6] ..... A42B 1/00

[52] U.S. Cl. ..... 2/181; 2/195.1

[58] Field of Search ..... 2/181, 183, 195.2, 2/195.3

[56] References Cited

U.S. PATENT DOCUMENTS

| | | | |
|---|---|---|---|
| 751,480 | 2/1904 | Drake | 2/181 |
| 1,190,427 | 7/1916 | Kromer, Jr. | 2/181 |
| 5,566,395 | 10/1996 | Nebeker | 2/181 |
| 5,584,076 | 12/1996 | Armstrong | 2/195.2 |
| 5,615,415 | 4/1997 | Beckerman | 2/195.3 |
| 5,715,540 | 2/1998 | Cho | 2/195.3 |
| 5,724,675 | 3/1998 | Lipkin et al. | 2/195.1 |

*Primary Examiner*—Diana Oleksa
*Assistant Examiner*—Kate M. Moran
*Attorney, Agent, or Firm*—Wood, Phillips, VanSanten, Clark & Mortimer

[57] ABSTRACT

A headwear piece has a crown defining a receptacle for the head of a wearer. The crown has an exposed external surface and an exposed internal surface with there being a circumferential portion of the exposed internal surface to engage the head of a wearer. The crown is defined by a plurality of joined fabric gores. Each of the fabric gores in a first plurality of the fabric gores has a single sheet of material that defines a part of the external surface of the crown and extends continuously to a folded portion which defines a part of the circumferential portion of the exposed internal surface of the crown.

22 Claims, 3 Drawing Sheets

Fig. 1
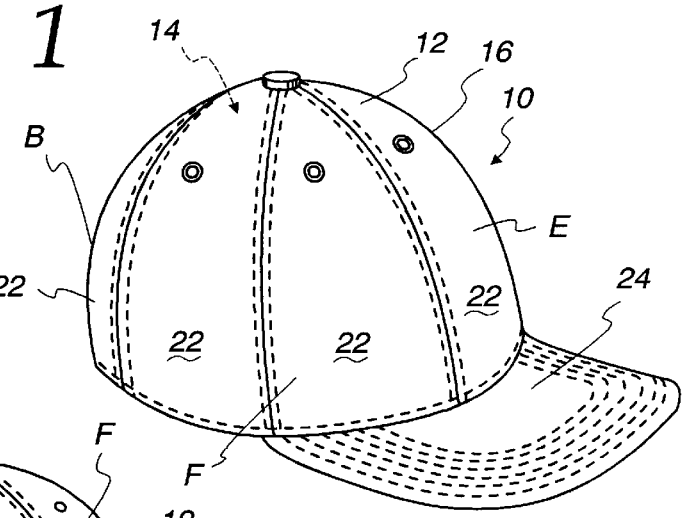
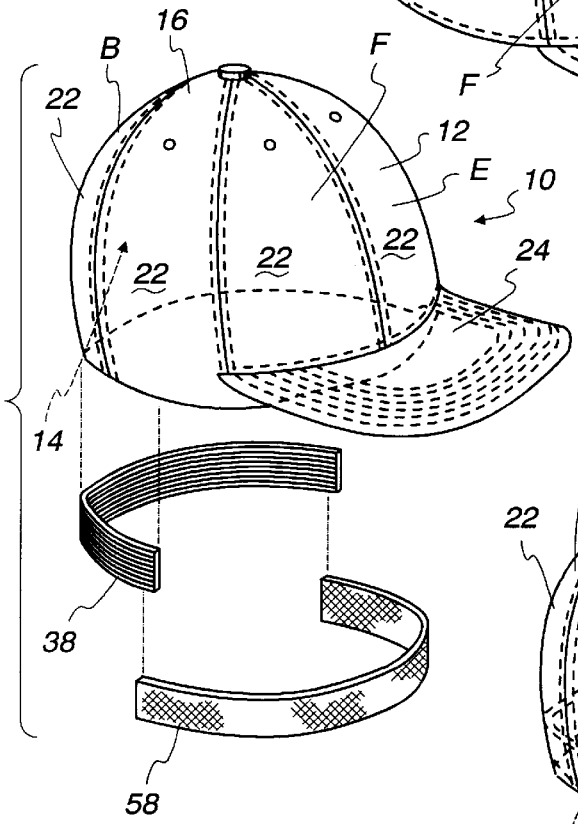
Fig. 2
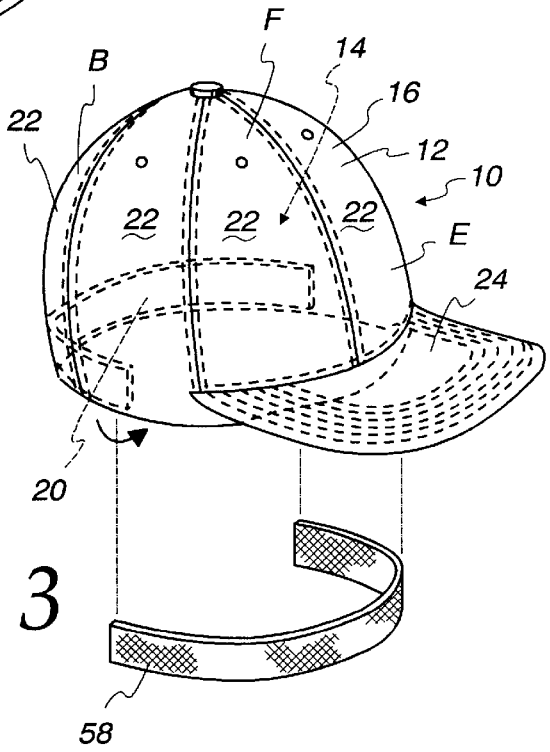
Fig. 3

HEADWEAR HAVING INTEGRAL CROWN AND HEADBAND

BACKGROUND OF THE INVENTION

1. Field of the Invention

This invention relates to headwear and, more particularly, to a headwear piece with a crown formed at least partially from a fabric sheet.

2. Background Art

It is well known to construct caps, such as baseball-style caps, from fabric gores. Typically, the gores are triangularly shaped and are sewn edge-to-edge to produce an inverted cup shape to accept a wearer's head. A circumferential bottom edge of the crown extends around and grips the wearer's head to maintain the headwear piece in place. A sweatband is commonly attached adjacent to the bottom edge within, and fully around, the crown to contact the wearer's head. One of the main purposes of the sweat band is to absorb perspiration and thereby avoid migration of perspiration through to the external surface of the crown as might detract significantly from its appearance.

It is also known to use a spandex-type material on gores of the crown. In U.S. Pat. No. 5,615,415, to Beckerman, it is taught that the rear gores can be made from a spandex material which allows the circumferential dimension of the gripping portion of the crown to change slightly. This allows each hat construction to fit a range of head sizes with a custom fit appearance. As a result, purveyors of these caps can offer a full range of sizes with fewer caps, thereby reducing inventory and simplifying inventory control. In U.S. Pat. No. 5,615,415, it is taught to construct the sweat band from material that is stretchable uniaxially around the circumference of the head gripping edge of the crown. To accommodate circumferential stretching of the crown, the sweatband is described to be sewn continuously around the entire bottom edge thereof and to be tacked to the crown at spotted locations near the top edge of the sweat band.

SUMMARY OF THE INVENTION

In one form of the invention, a headwear piece has a crown defining a receptacle for the head of a wearer. The crown has an exposed external surface and an exposed internal surface with there being a circumferential portion of the exposed internal surface to engage the head of a wearer. The crown is defined by a plurality of joined fabric gores. Each of the fabric gores in a first plurality of the fabric gores has a single sheet of material that defines a part of the external surface of the crown and extends continuously to a folded portion which defines a part of the circumferential portion of the exposed internal surface of the crown.

The crown may include a sweat absorbing material separate from the fabric gores and defining only a part of the circumferential portion of the exposed internal surface of the crown.

In one form, the headwear piece has a front and rear and a visor projects forwardly from the crown.

The crown may have an inverted cup shape which bounds the receptacle.

At least one of the gores may be defined by a spandex material.

In one form, the headwear piece has a bottom opening and the crown is bounded by a circumferential edge through which a wearer's head passes as the wearer's head is directed into the crown receptacle. All of the gores defining the crown may each be defined by a sheet of material that defines a part of the external surface of the crown and extends continuously to a folded portion which resides within the crown receptacle. The folded portions of the gores may each extend upwardly within the receptacle to an upper edge, with the folded portions of the gores cooperatively extending through at least 270° around the circumferential edge of the crown opening.

In one form, the folded portions of the gores cooperatively extend through 360° around the circumferential edge of the crown opening.

The upper edge of the folded portions of the gores may extend upwardly from the circumferential edge of the crown opening substantially a uniform distance through the at least 270° around the circumferential edge of the crown opening.

In one form, each of the gores has a main portion that defines a part of the external surface of the crown and the folded portion of each gore is stitched to the main portion of each gore.

A horizontal line of stitching may join the main portion and folded portion of each gore.

In one form, the folded portion of each gore extends upwardly to an edge and the sweat absorbing material extends upwardly beyond the edges of the folded portions of the gores at the front of the crown.

The sweat absorbing material may extend no more than on the order of 240° around the circumferential edge of the crown opening.

The sweat absorbing material may extend through less than 360° around the circumferential edge of the crown opening.

The invention also contemplates a headwear piece having a crown defining a receptacle for the head of a wearer, with the crown having a top and bottom and a bottom opening bounded by a circumferential edge through which a wearer's head passes as the wearer's head is directed into the crown receptacle. The crown has an exposed external surface and an exposed internal surface with there being a circumferential portion of the exposed internal surface to engage the head of a wearer. The crown has a single fabric sheet that defines a part of the external surface of the crown and extends continuously to a folded portion which defines a part of the circumferential portion of the exposed internal surface of the crown.

In one form, the crown has a plurality of fabric sheets, which sheets define a part of the external surface of the crown and extend continuously to a folded portion which defines a part of the circumferential portion of the exposed internal surface of the crown, with the plurality of fabric sheets cooperatively extending through at least 270° around the circumferential edge bounding the crown opening. The folded portions are directly exposed within the receptacle around a part of the circumferential edge.

BRIEF DESCRIPTION OF THE DRAWINGS

FIG. 1 is a perspective view of a headwear piece made according to the present invention;

FIG. 2 is an exploded, perspective view of the headwear piece in FIG. 1 showing an elastic band and a sweatband separated from a crown of the headwear piece;

FIG. 3 is a view as in FIG. 2 with the elastic band operatively connected to the crown;

DETAILED DESCRIPTION OF THE DRAWINGS

Figure 4:
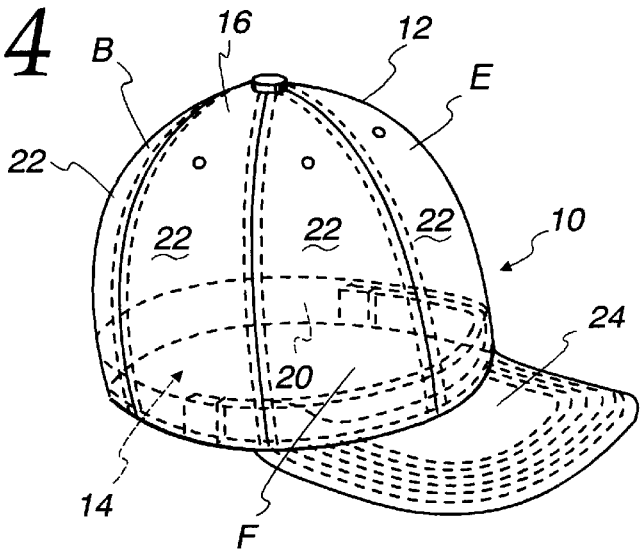
FIG. 4 is a view as in FIG. 1 and showing both the elastic band and sweatband operatively connected to the crown.

A headwear piece, according to the present invention, is shown at 10 in FIGS. 1–8. The headwear piece has a crown 12 defining a cup-shaped receptacle 14 for the head of a wearer. The crown 12 has an exposed external surface 16 and an exposed internal surface 18. The internal surface 18 has a circumferential portion 20 at the bottom of the crown 12 which engages and embraces the head of a wearer to frictionally maintain the headwear piece 10 operatively on a wearer's head.

The crown 12 is defined by a plurality of triangularly-shaped gores 22 which are sewn edge-to-edge to produce the cup shape for the crown 12. A bill/visor 24 projects forwardly from the crown 12 to produce a conventional baseball-style cap configuration.

Figure 5:
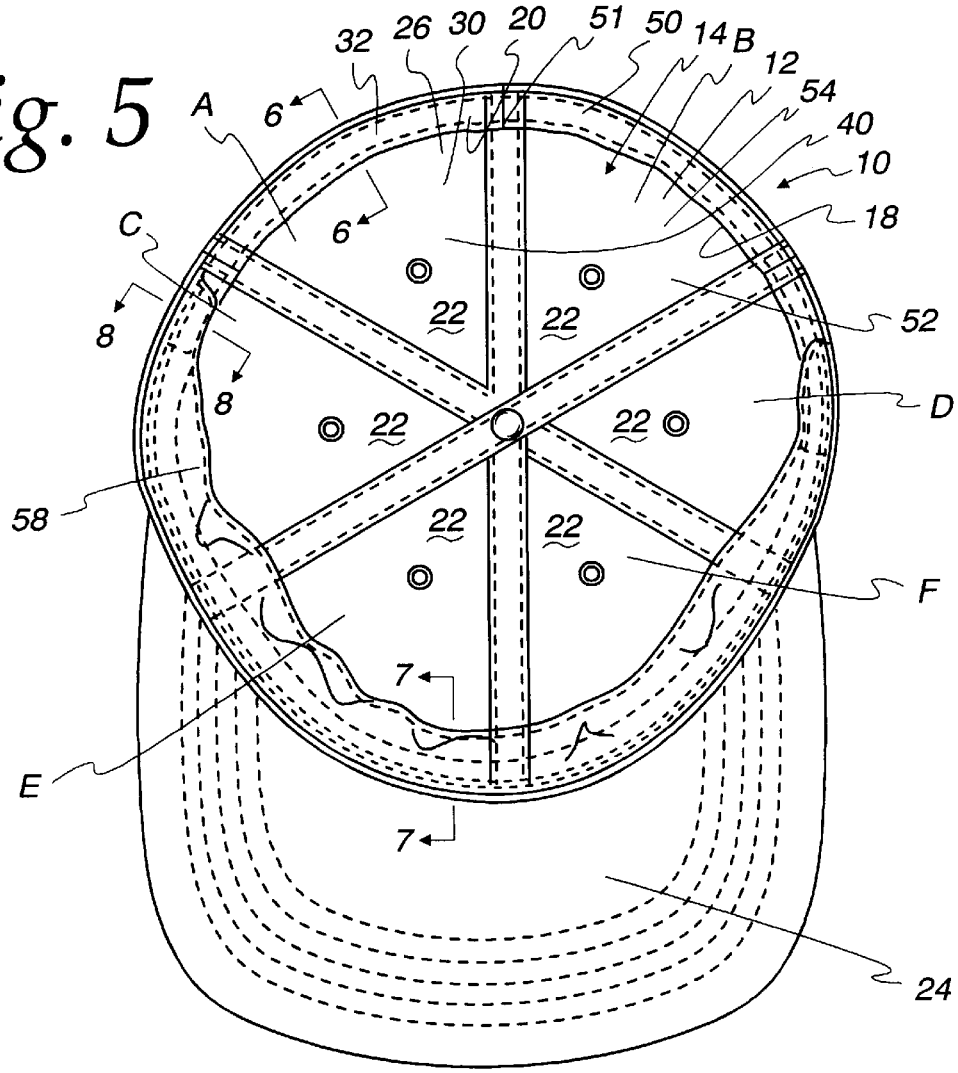
FIG. 5 is an enlarged, bottom view of the headwear piece in FIGS. 1–4.
Figure 6:
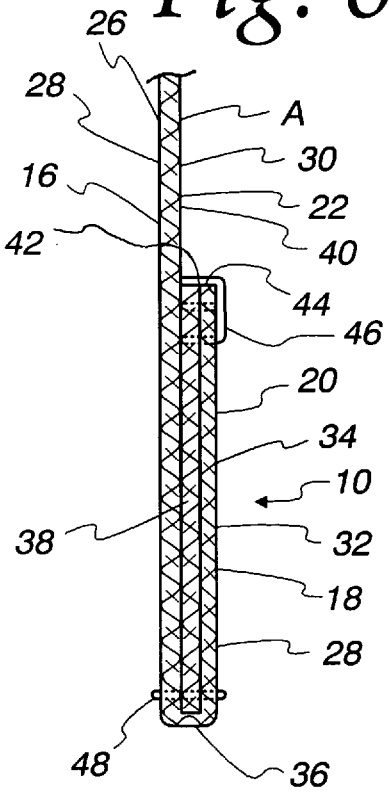
FIG. 6 is an enlarged, fragmentary, cross-sectional view of the crown taken along line 6—6 of FIG. 5.
Figure 7:
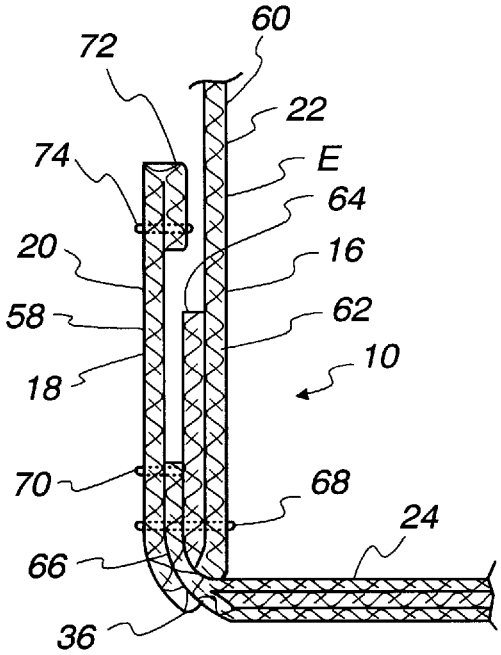
FIG. 7 is an enlarged, fragmentary, cross-sectional view of the crown taken along line 7—7 of FIG. 5.

Each of the gores 22 is made from a fabric material. Some, or all, of the gores can be made from a spandex fabric which permits the portion 20 of the crown 12 to expand circumferentially to accommodate a plurality of different head sizes while producing a custom fit appearance. Exemplary gore 22, identified by A in FIGS. 5 and 6, is defined by a single sheet 26 having oppositely facing surfaces 28, 30, with the surface 28 defining a part of the external surface 16 of the crown 12. A portion 32 of the gore A is folded back upon itself within the crown receptacle 14 so that a portion 34 of the surface 28 is exposed to define a part of the circumferential portion 20 of the internal surface 18 which engages a wearer's head. Preferably, the sheet 26 is formed as one piece which extends continuously from the top of the headwear piece 10 and wraps around to the portion 32 so that the sheet 26 defines a bottom circumferential edge 36 of the crown 12 extending around the receptacle 14 and defining an entry opening for the head of a wearer.

An elastic band 38 is located between a main portion 40 of the sheet 26 and the folded portion 32. The upper edge 42 of the elastic band 38 and the upper edge 44 of the folded gore portion 32 are joined by a line of stitching 46. A horizontal line of stitching 48 extends through the main portion 40 of the sheet 26, the folded portion 32, and the elastic band 38.

The adjacent gore 22, identified as B, is formed in the same manner with the elastic band 38. Preferably, the elastic band 38 extends around the full circumferential extent of the gores A and B. More preferably it extends through on the order of 180° around the back half of the crown 12. By reason of extending around the crown 12 through 180°, the elastic band 38 extends circumferentially over a part of the gores 22 identified as C and D.

The folded portions 32, 50 of the gores A, B, respectively, at the junction thereof, are joined through stitching at 51 to the main portions 40, 52 of the sheet 26 defining the gore A and the sheet 54 defining the gore B, adjacent to the top of the folded portions 32, 50, so that that part of the circumferential portion 20 near the stitching 51 cannot be folded downwardly out of the receptacle 14.

A sweat band 58, made of conventional sweat absorbing cloth, extends around the circumferential portion 20 through 180° at the front of the crown 12. As seen in the exemplary gore 22 identified as E, the fabric sheet 60 has a main portion 62 and a folded portion 64 doubled back against the main portion 62 within the receptacle 14. A flap 66 on the bill/visor 24 overlies the folded sheet portion 64. The sweat band 58 in turn overlies the flap 66 and the folded portion 64 with a line of stitching 68 extending through the main and folded portions 62, 64, the flap 66, and the sweat band 58 adjacent to the bottom 36 of the receptacle 14. A separate line of stitching 70, spaced above the line of stitching 68, joins the sweat band 58 to the bill/visor flap 66. The upper portion 72 of the sweat band 58 is folded over itself and secured by a line of stitching 74. The gore 22 identified as F is formed in the same manner.

Figure 8:
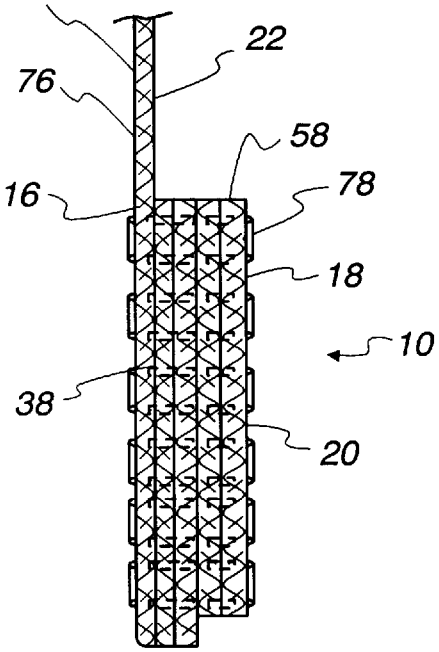
FIG. 8 is an enlarged, fragmentary, cross-sectional view of the crown taken along line 8—8 of FIG. 5.

As seen in FIG. 8, at opposite sides of the crown 12, and midway between the front and rear of the crown 12, the sweat band 58 and elastic band 38 overlap. On the exemplary gore 22 identified as C, the sheet 76 cooperates with the elastic band 38 in the same manner as do the gores 22 identified as A and B. The elastic band 58 is doubled over itself and overlies the sheet 76 and is stitched thereto by a vertical line of stitching 78.

With this arrangement, the sweat band 58 defines a portion of the circumferential part 20 of the internal surface 18 at the front of the crown 12 and preferably extends upwardly beyond the folded portions of the gores C, D, E, F within the receptacle 14. The remainder of the circumferential portion of the internal surface 18 that is directly exposed to the wearer's head is defined by the sheets defining the gores 22 identified as A, B, C, D. In a preferred form, the sweat band 58 extends on the order of 240° around the circumference of the crown 12, rather than 360° as is common to this conventional type of cap. The folded portions of the gores A, B, C, D, E, F preferably extend fully around the circumference of the portion 20 of the crown and in any event preferably not less than 270° therearound.

With the construction described, the circumferential stretching of the spandex material defining the gores 22 can be exploited with the spandex material itself being directly exposed to the wearer's head around a portion of the circumference thereof.

The foregoing disclosure of specific embodiments is intended to be illustrative of the broad concepts comprehended by the invention.

I claim:

1. A headwear piece comprising:

a crown defining a receptacle for the head of a wearer, the crown having an exposed external surface and an exposed internal surface with there being a circumferential portion of the exposed internal surface to directly engage the head of a wearer, the crown being defined by a plurality of joined fabric gores, each of the fabric gores in a first plurality of the fabric gores comprising a single sheet of material that defines a part of the external surface of the crown and extends continuously to a folded portion which defines a part of the circumferential portion of the exposed internal surface of the crown and is exposed to directly engage the head of a wearer.

2. The headwear piece according to claim 1 wherein the headwear piece has a front and rear, and the headwear piece further comprises a visor projecting forwardly from the crown.

3. The headwear piece according to claim 1 wherein the crown has an inverted cup shape which bounds the receptacle for the head of a wearer.

4. The headwear piece according to claim 1 wherein there is at least one gore that comprises a spandex material.

5. The headwear piece according to claim 4 wherein the gores in each of the first plurality of gores comprise a spandex material.

6. The headwear piece according to claim 1 wherein the headwear piece has a top and bottom with there being a bottom opening in the crown bounded by a circumferential edge through which a wearer's head is directed into the crown receptacle, wherein all of the gores defining the crown are each defined by a sheet of material that defines a part of the external surface of the crown and extends continuously to a folded portion which resides within the crown receptacle, the folded portions of the gores each extend upwardly within the receptacle to an upper edge, and the folded portions of the gores cooperatively extend through at least 270° around the circumferential edge of the crown opening.

7. The headwear piece according to claim 6 wherein the folded portions of the gores cooperatively extend through 360° around the circumferential edge of the crown opening.

8. The headwear piece according to claim 6 wherein the upper edges of the folded portions of the gores extend upwardly from the circumferential edge of the crown opening substantially a uniform distance through the at least 270° around the circumferential edge of the crown opening.

9. The headwear piece according to claim 8 wherein each of the gores has a main portion that defines a part of the external surface of the crown and the folded portions of each gore are stitched to the external portion of each gore.

10. The headwear piece according to claim 9 wherein there is a horizontal line of stitching which joins the main portion and folded portion of each gore.

11. The headwear piece according to claim 1 further comprising an elastic band sewn to the folded portion.

12. A headwear piece comprising:

a crown defining a receptacle for the head of a wearer, the crown having an exposed external surface and an exposed internal surface with there being a circumferential portion of the exposed internal surface to engage the head of a wearer, the crown being defined by a plurality of joined fabric gores, each of the fabric gores in a first plurality of the fabric gores comprising a single sheet of material that defines a part of the external surface of the crown and extends continuously to a folded portion which defines a part of the circumferential portion of the exposed internal surface of the crown, wherein the crown comprises a sweat absorbing material separate from the fabric gores and defining only a part of the circumferential portion of the exposed internal surface of the crown.

13. The headwear piece according to claim 12 wherein the headwear piece has a front and rear, a top and bottom, and a front wall, the folded portion of each gore extends upwardly to an edge, and the sweat absorbing material extends upwardly beyond the edges of the folded portions of the gores at the front of the crown.

14. The headwear piece according to claim 12 wherein the crown has a bottom opening bounded by a circumferential edge and the sweat absorbing material extends through no more than on the order of 240° around the circumferential edge of the crown opening.

15. The headwear piece according to claim 12 wherein the crown has a bottom opening bounded by a circumferential edge and the sweat absorbing material extends through less than 360° around the circumferential edge of the crown opening.

16. A headwear piece comprising:

a crown defining a receptacle for the head of a wearer, the crown having a top and bottom with there being a bottom opening in the crown bounded by a circumferential edge through which a wearer's head passes as the wearer's head is directed into the crown receptacle, the crown having an exposed external surface and an exposed internal surface with there being a circumferential portion of the exposed internal surface to directly engage the head of a wearer, the crown comprising a single fabric sheet that defines a part of the external surface of the crown and extends continuously to a folded portion which defines a part of the circumferential portion of the exposed internal surface of the crown and is exposed to directly engage the head of a wearer.

17. The headwear piece according to claim 16 further comprising an elastic band sewn to the folded portion.

18. The headwear piece according to claim 16 wherein the crown comprises a plurality of fabric sheets which each define a part of the external surface of the crown and extend continuously to a folded portion which defines a part of the circumferential portion of the exposed internal surface of the crown, the plurality of fabric sheets cooperatively extend through at least 270° around the circumferential edge bounding the crown opening and the folded portions are directly exposed within the receptacle around a part of the circumferential edge.

19. The headwear piece according to claim 18 wherein the fabric sheet comprises a spandex material.

20. The headwear piece according to claim 19 wherein the crown has a front and rear and a front wall and further comprising a sweat absorbing material attached to the front of the crown.

21. The headwear piece according to claim 18 wherein the crown further comprises a sweat absorbing material overlying the folded portions of the sheets and extending through no more than on the order of 240° around the circumferential edge.

22. The headwear piece according to claim 16 wherein the crown has a front and rear and the headwear piece further comprises a visor projecting forwardly from the crown.

* * * * *